US005941453A

United States Patent [19]

Oliff

[11] Patent Number: 5,941,453

[45] Date of Patent: Aug. 24, 1999

[54] LOCKING ARRANGEMENT FOR PANELS

[75] Inventor: James R. Oliff, Douglasville, Ga.

[73] Assignee: The Mead Corporation, Dayton, Ohio

[21] Appl. No.: 09/086,729

[22] Filed: May 29, 1998

[51] Int. Cl.[6] ..... B65D 5/02

[52] U.S. Cl. ..... 229/158; 229/103.2; 229/198.2

[58] Field of Search ..... 229/103.2, 155, 229/158, 198.2; 206/140, 427

[56] References Cited

U.S. PATENT DOCUMENTS

| | | | |
|---|---|---|---|
| 2,053,857 | 9/1936 | Weiss | 229/185 |
| 3,027,063 | 3/1962 | Zastrow | 229/155 |
| 3,249,284 | 5/1966 | Wood | 229/198.2 |
| 3,341,908 | 9/1967 | Lock | 229/103.2 |
| 3,497,924 | 3/1970 | Lock | 229/158 |
| 3,627,541 | 12/1971 | Farquhar | 229/103.2 |
| 3,701,181 | 10/1972 | Lock | 229/198.2 |
| 3,705,681 | 12/1972 | Rossi et al. | 229/103.2 |
| 4,600,140 | 7/1986 | Milliens | 229/198.2 |
| 4,611,754 | 9/1986 | Sutherland | 229/198.2 |
| 4,708,284 | 11/1987 | Sutherland et al. | 229/198.2 |
| 5,180,100 | 1/1993 | Shimizu | 229/198.2 |

FOREIGN PATENT DOCUMENTS

| | | | |
|---|---|---|---|
| 986063 | 3/1976 | Canada | 229/103.2 |
| 89/10307 | 11/1989 | WIPO | 229/103.2 |

*Primary Examiner*—Gary E. Elkins
*Attorney, Agent, or Firm*—Thomas A. Boshinski

[57] ABSTRACT

A locking arrangement for panels includes a first panel, a locking tab extending from the first panel, a second panel having a main portion, and a leading portion connected thereto along a plurality of collinear panel fold lines, and a pair of locking slits defined in the second panel. Each locking slit extends at least from a first point disposed astride one of the panel fold lines, into the leading portion and to a second point disposed on the main portion, and the locking slits defining therebetween a strut panel. The locking tab is received into the slits, and is held between the strut panel and the second panel. A strut fold line may be disposed across the strut panel from the locking slit to the cut edge substantially in parallel to the panel fold line, the strut fold line being disposed in an offset relationship to the panel fold line in a direction toward the leading portion, whereby folding of the leading portion at least partially opens the locking slit for receiving the locking tab thereinto.

22 Claims, 7 Drawing Sheets

LOCKING ARRANGEMENT FOR PANELS

BACKGROUND OF THE INVENTION

The present invention relates generally to interlocking arrangements for panels, and more particularly to a locking arrangement for panels wherein a locking tab forms a cooperative slide locking engagement with a pair of locking slits.

In the packaging of articles, and particularly of one or more articles in wrap-around type cartons, locking arrangements are frequently used for maintaining closure of the carton about the articles. It can be appreciated that such locking arrangements must be securely and reliably engaged, and must remain in such condition until the carton is opened.

One well-known form of locking arrangement comprises a locking tab and cooperating slit. An example of this type of locking arrangement can be seen in U.S. Pat. No. 3,249,284 (Wood). In this example, as is typical, the locking tab includes a head portion attached along a relatively narrow neck to a panel of the carton. The tab includes at least one shoulder, i.e., that portion of the tab where the head connects with the relatively narrow neck. On an opposite panel of the carton, a slit is formed into which the tab may be inserted. Following insertion, the tab shoulder engages the end of the slit, preventing the tab from being withdrawn, and thereby securing the lock.

For locks of this type, it is advantageous to provide means to facilitate opening of the slit for receiving the locking tab as it is inserted. Otherwise, the tab or slit may be damaged during engagement, or the tab may miss engagement with the slit altogether. Thus, it is known to arrange the slit such that as a leading portion of the panel in which the slit is formed is folded away, the slit is opened. Such an arrangement may be seen, for example in U.S. Pat. No. 4,600,140, in which the slit includes angled portions for creating the opening. However, it is also important to ensure that once inserted, the tab remains firmly engaged with the slit. When the leading edge panel has been folded away, the edge panel may not completely return to its original position, thereby leaving the slit partially opened.

One way in which secure retention can be accomplished is to have a portion of the tab which is folded over into overlapping relation with the main tab body. After insertion, the folded portion is released and at least partially unfolds, thereby providing additional security to the lock. An example of this approach can be seen in the above-referenced U.S. Pat. No. 4,600,140. One disadvantage of this approach, however, is the additional complexity required in machinery for forming and locking cartons.

SUMMARY OF THE INVENTION

In meeting the foregoing needs, the present invention provides a locking arrangement for panels including a first panel, and a locking tab extending from the first panel, the locking tab having a main body defining a widened shoulder portion disposed along at least one side edge of the tab adjacent the neck. A second panel has a main portion, and a leading portion is connected thereto along at least one panel fold line. A locking slit is defined in the second panel, extending at least from a first point disposed on the leading portion to a second point disposed on the main portion. A cut edge is also defined in the second panel, extending at least from a first point disposed in the leading portion to a second point disposed in the main portion. The locking slit and the cut edge define therebetween a strut panel, and a strut fold line is disposed across the strut panel from the locking slit to the cut edge substantially in parallel to the panel fold line, the strut fold line being disposed in an offset relationship to the panel fold line in a direction toward the leading portion, whereby folding of the leading portion along the panel fold line causes the strut fold line and the strut panel to at least partially open the locking slit for receiving the locking tab thereinto.

The locking tab may further define a second widened locking shoulder disposed along an opposite side edge of the tab.

The locking tab may further include a neck disposed between the locking shoulder and the first panel. In such a case, the locking tab may define a locking edge formed along the neck between the locking shoulder and the first panel, and the first portion of the locking slit may be formed such that, when the locking tab is engaged with the locking slit, the locking edge and the first portion of the locking slit are substantially coincident.

A second panel fold line may be provided, the first and second panel fold lines being collinear. The cut edge may then be defined by a second locking slit formed in the second panel. Also, each of the first and second locking slits may extend from the first points, with each of the first points being disposed astride a respective one of the panel fold lines, into the leading portion and to the second points disposed on the main portion. Each of the locking slits may include a first portion extending from the first point into the leading portion and a second portion extending from the leading portion into the main portion, and a shoulder portion disposed within the leading portion and which connects the first and second portions of each of the locking slits. The strut fold line may be disposed across the strut panel from the first locking slit to the second locking slit, intersecting each of the locking slits between respective ones of the shoulder portions and the intersection of the locking slit and one of the panel fold lines.

The first and second locking slits may be substantially mirror-images of each other. The first portion of each of the locking slits may extend beyond the first point and into the main portion of the second panel.

The second panel may define a panel side edge therefor, and wherein the cut line is defined by a portion of the panel side edge.

In accordance with another aspect of the present invention, a locking arrangement for panels includes a first panel, and a locking tab extending from the first panel, the locking tab having a main body defining a widened shoulder portion disposed along at least one side edge of the tab adjacent the neck. A second panel has a main portion, and a leading portion is connected thereto along a plurality of collinear panel fold lines. A pair of locking slits are defined in the second panel, each extending at least from a first point disposed astride one of the panel fold lines, into the leading portion and to a second point disposed on the main portion. The locking slits define therebetween a strut panel. The distance between the first points is greater than the distance between the second points, whereby the locking tab is received into the slits.

In this embodiment, the locking tab may further define a second widened locking shoulder disposed along an opposite side edge of the tab, the locking shoulders engaging the locking slits for retaining the locking tab within the locking slits. The locking tab in this case may define a maximum width thereacross at the locking shoulders which is less than or equal to the distance between the first points along the locking slits.

The locking tab may further comprise a neck disposed between the locking shoulder and the first panel. The locking tab may define a locking edge formed along the neck between the locking shoulder and the first panel, wherein the first portion of the locking slit is formed such that, when the locking tab is engaged with the locking slit, the locking edge and the first portion of the locking slit are substantially coincident.

Each of the locking slits may include a first portion extending from the first point into the leading portion and a second portion extending from the leading portion into the main portion, and a shoulder portion disposed within the leading portion and which connects the first and second portions of each of the locking slits. The first and second locking slits may be substantially mirror-images of each other. Also, the first portion of each of the locking slits may extend beyond the first point and into the main portion of the second panel.

The locking tab may define thereon a leading tab edge extending between the locking shoulders, and the main body of the tab may define an alignment notch extending thereinto from the tab leading edge to a notch base, the alignment notch along the leading tab edge having a width greater than the distance between the second points on the locking slits whereby the alignment notch cooperates with the strut panel to laterally retain the locking tab within the locking slits. The alignment notch may further define a greater width along the tab leading edge than at the notch base.

Other advantages and objects of the present invention will be apparent from the following description, the accompanying drawings, and the appended claims.

DETAILED DESCRIPTION OF THE PREFERRED EMBODIMENT

Figure 1:
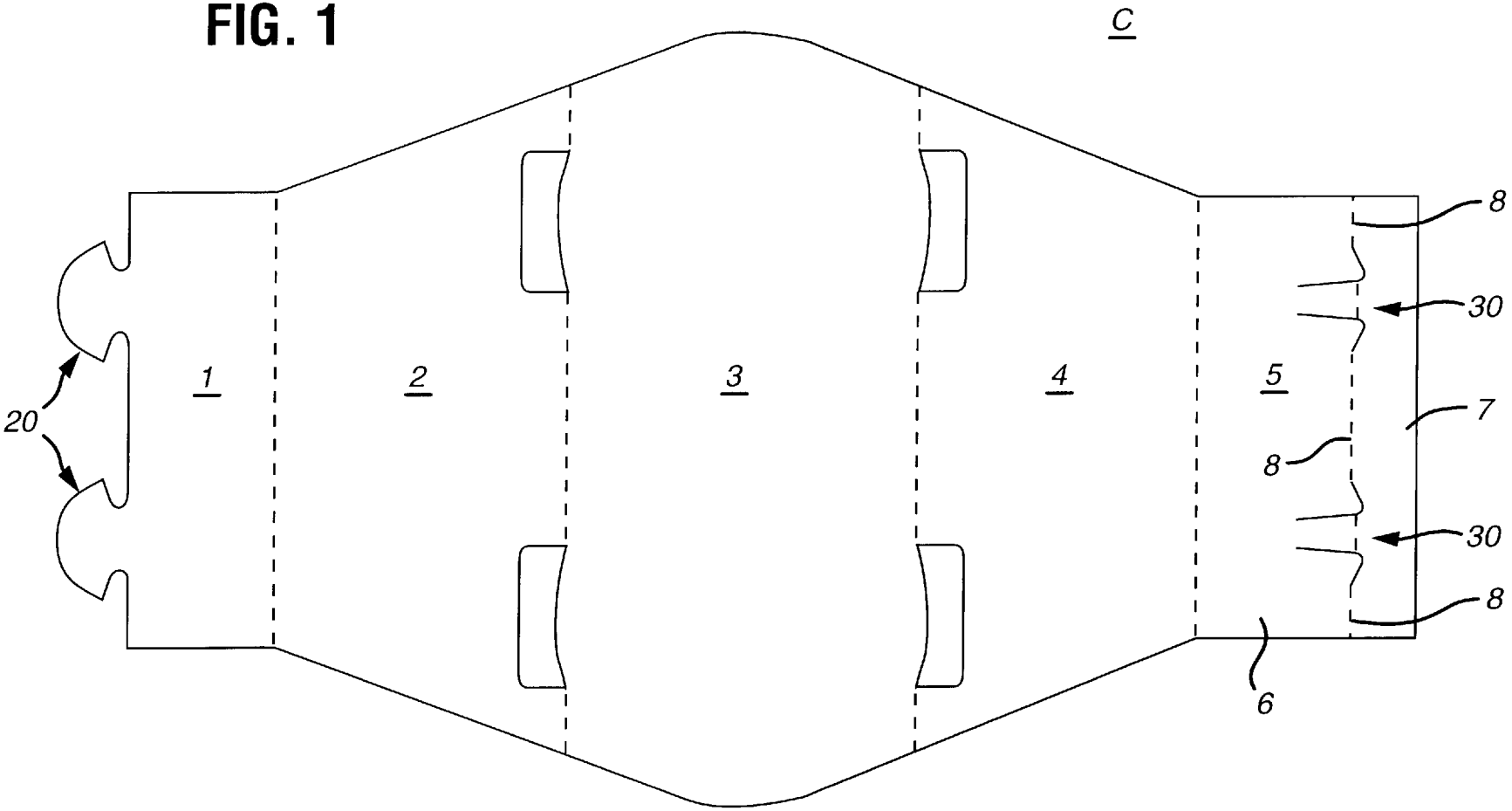
FIG. 1 is a plan view illustration of a carton blank including a locking arrangement for panels in accordance with a preferred embodiment of the invention.

Throughout the drawings the same reference numerals are used to denote the same features.

Referring first to FIG. 1, a paperboard carton blank C is illustrated which includes an interlocking arrangement for panels in accordance with a preferred embodiment of the invention. In the illustrated embodiment, the blank C is configured to form a carton of a wrap-around type carton having closure panels 1 and 5, side wall panels 2 and 4, and top panel 3. Male locking tabs 20 extend from one of the closure panels 1 while corresponding locking slits are formed in the other closure panel 5 as indicated generally at 30. Closure panel 5 is formed from a main panel 6 and a leading panel 7 connected along a plurality of collinear fold lines 8.

Although the illustrated embodiment includes a carton for forming a relatively simple wrap-around style carton, it will be understood that the interlocking arrangement of the present invention is usable in any carton or other application in which panels of a sheet material are to be secured by means of a slide-type interlock.

Figure 2:
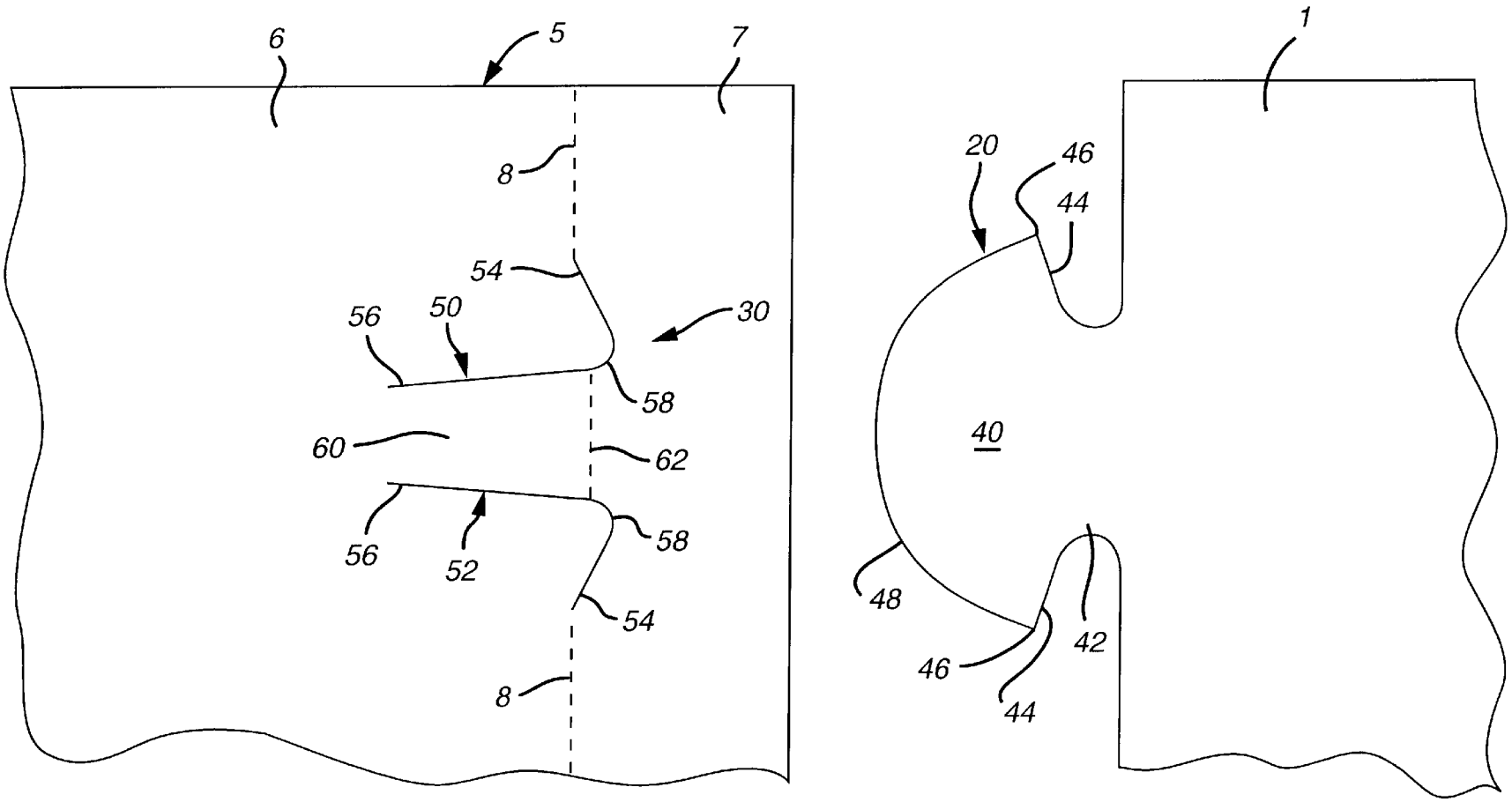
FIG. 2 is a plan view illustration showing enlarged portions of a carton during formation, including the locking arrangement of FIG. 1 positioned for engagement.

The locking arrangement of FIG. 1 is shown in greater detail in FIG. 2. A portion of closure panel 1 is shown, which portion includes one of the locking tabs 20 attached thereto. A portion of closure panel 5 including main panel 6 and leading panel 7 are also shown, positioned as they would appear during folding of the blank to form the carton, just prior to insertion of tab 20 into the corresponding slit arrangement 30 located in panels 6 and 7.

Locking tab 20 includes a main body 40 which is connected to panel 1 by a relatively narrow neck 42. The transition between neck 42 and body 40 defines a locking edge 44, which edge terminates at a shoulder portion 46. Body 40 defines a leading edge 48 for the tab, which in this embodiment is formed generally as a circular edge running from shoulder to shoulder. Optionally, a fold line (not shown) may be formed transversely across neck 42, and may be collinear with the leading edge of panel 1.

The slit arrangement 30 comprises a pair of slits 50 and 52, formed as mirror-images of each other. Each slit 50, 52 includes a first portion 54 which extends from the fold line 8 at an outward angle into the leading edge panel 7. A second portion 56 extends rearwardly into the main panel 6, with the first and second portions 54 and 56 being joined at a shoulder 58. In the preferred embodiment, shoulder 58 is formed as a curved portion of slit 50, 52, although other configurations may be used.

The second portions 56 of slits 50 and 52 form between them a strut panel 60. Strut panel 60 is connected at one end to main panel 6, and at an opposite end to leading panel 7 adjacent slit shoulders 58. A fold line 62 is formed across the strut panel 60, and is disposed parallel to fold lines 8. Fold line 62 is further displaced in an offset condition with respect to fold lines 8, being offset in the direction of the leading edge of panel 7.

For locking, after carton blank has been wrapped around the article or articles to be packaged, panel 1 is positioned with respect to panels 6 and 7 as shown generally in FIG. 2. Leading panel 7 is folded out of the plane of main panel 6 along fold lines 8. The forwardly-extending portions of slits 50 and 52 in the vicinity of shoulders 58 provide an opening beneath the shoulder areas to allow tab 20 to pass below panel 6 for engagement with slits 50 and 52.

It can also be seen that the offset position of fold line 62 will force strut panel 60 out of the plane of main panel 6, thereby further opening entry to the locking slits 50 and 52 for tab 20. Tab 20 is then inserted beneath panel 6, over strut tab 62 and into engagement with slits 50 and 52. The tab is inserted sufficiently far to cause locking edges 44 of tab 20 to pass first portions 54 of slits 50 and 52. At a maximum, the tab 20 can be inserted only to the ends of slits 50 and 52, thereby preventing overtightening of the blank around the package contents, which can damage the carton blank or its contents.

After tab 20 has been inserted, the locking edges 44 of tab 20 will be captured by portions 54 of slits 50 and 52, thereby preventing the lock from becoming disengaged. The lock of FIG. 2 can be seen in its engaged condition in FIG. 3.

Figure 3:
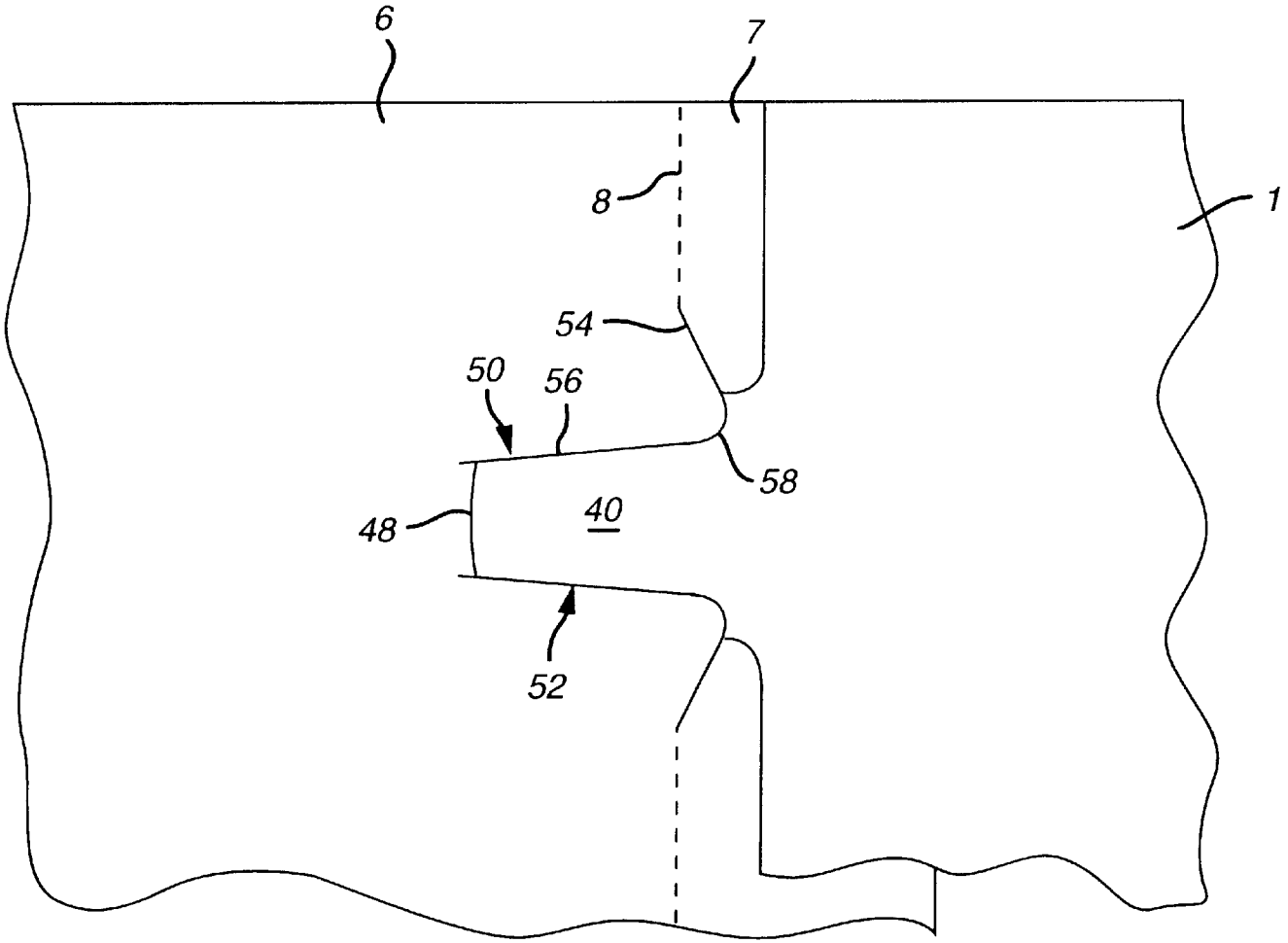
FIG. 3 is plan view similar to FIG. 2, showing the carton portions following engagement of the locking arrangement.

One advantage of the lock arrangement of the present invention can be appreciated from the illustration of FIG. 3. When in its locked condition, the locking tab 20 is disposed with paperboard portions from the receiving panel located both above and below the locking tab. In particular, the portions of panel 5 adjacent to slit portions 56 are positioned against the shoulder portions 46 of tab 20, while on the opposite side of the tab, the strut panel 60 is positioned against the central portion of the locking tab 20. This is advantageous in that because the locking tab is held firmly in position, the locking edges 44 of head 40 are maintained in locking contact with slit portions 54, thereby increasing the security of the locking arrangement against inadvertent disengagement.

Figure 4:
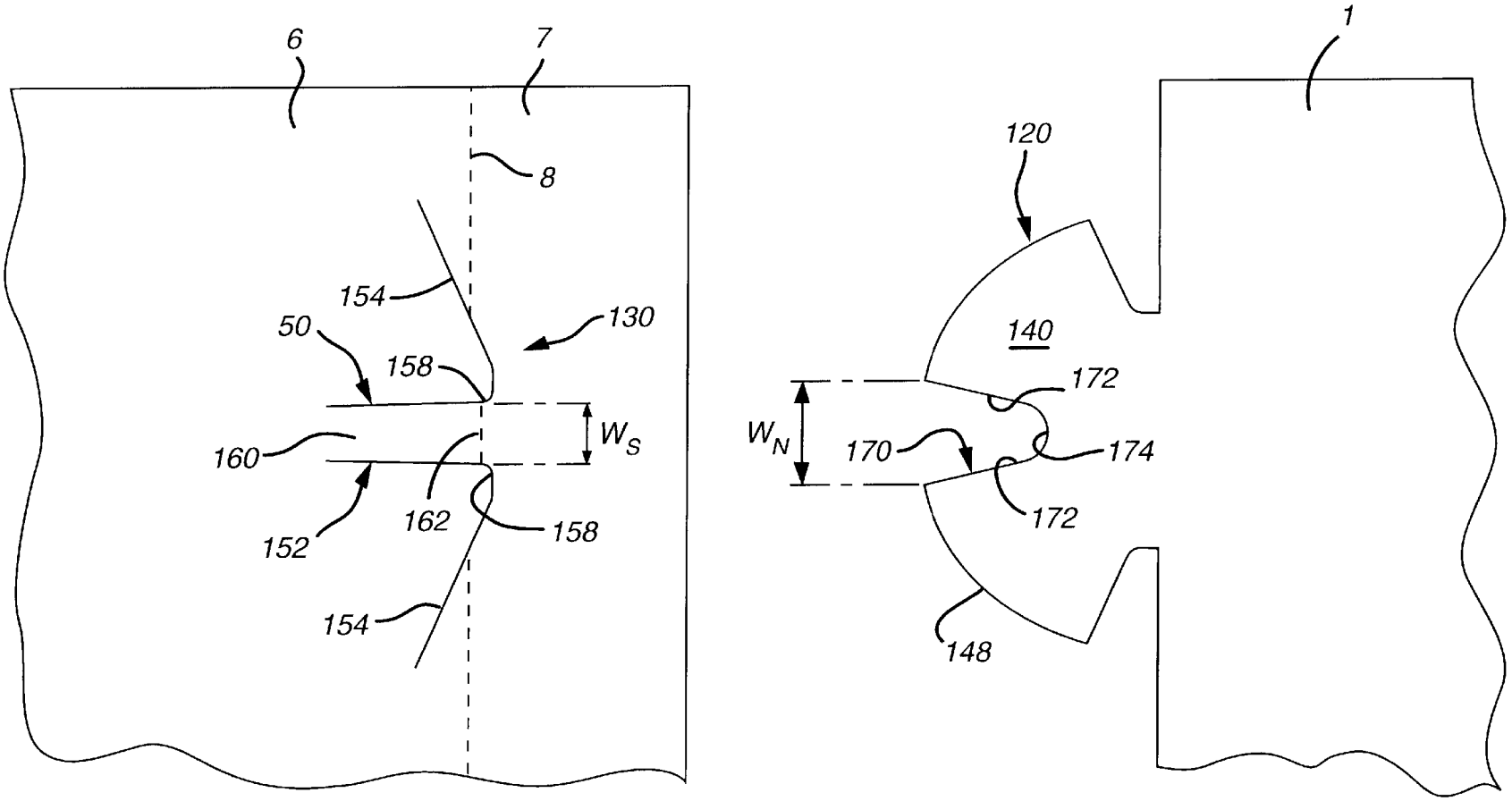
FIGS. 4 and 5 are views similar to FIGS. 2 and 3, respectively, showing an alternative embodiment for the locking arrangement of the present invention.

An additional feature of the present invention can be seen by reference to the alternate embodiment for the locking arrangement shown in FIG. 4. Panels 5 and 6 define therein a slit arrangement 130 similar to that used in the embodiment of FIGS. 1–3. Panel 1 is provided with a locking tab 120, which is generally similar to locking tab 20 used in the previous embodiment. However, in this embodiment, locking tab 120 includes a main body 140 into which an alignment notch 170 is formed, extending from leading edge 148. Along leading edge 148, notch 170 is of a width $W_N$ which is greater than the widest width $W_S$ of strut panel 160. Notch 170 is further formed having side edges 172 which preferably taper inwardly, thereby decreasing the width of the notch 170 near its innermost base portion 174. Notch 170 extends into main body 140, but to a depth less than the distance from leading edge 148 to the base of the locking tab 120 at panel 1.

In use, tab 120 is inserted into slit arrangement 130 in a manner similar to that used for the embodiment shown in FIGS. 1–3. During insertion, and as seen from FIG. 5, tab 120 is inserted beyond the innermost portion of strut panel 160. The side edges 172 of notch 170 will interact with the innermost ends of slits 150, 152 engage the side edges of strut panel 160, thereby guiding the insertion of tab 120, with the end of strut panel 160 being finally disposed within notch 170. As a result, tab 120 is properly laterally located within the slit arrangement, and is retained in such position after locking.

Figure 5:
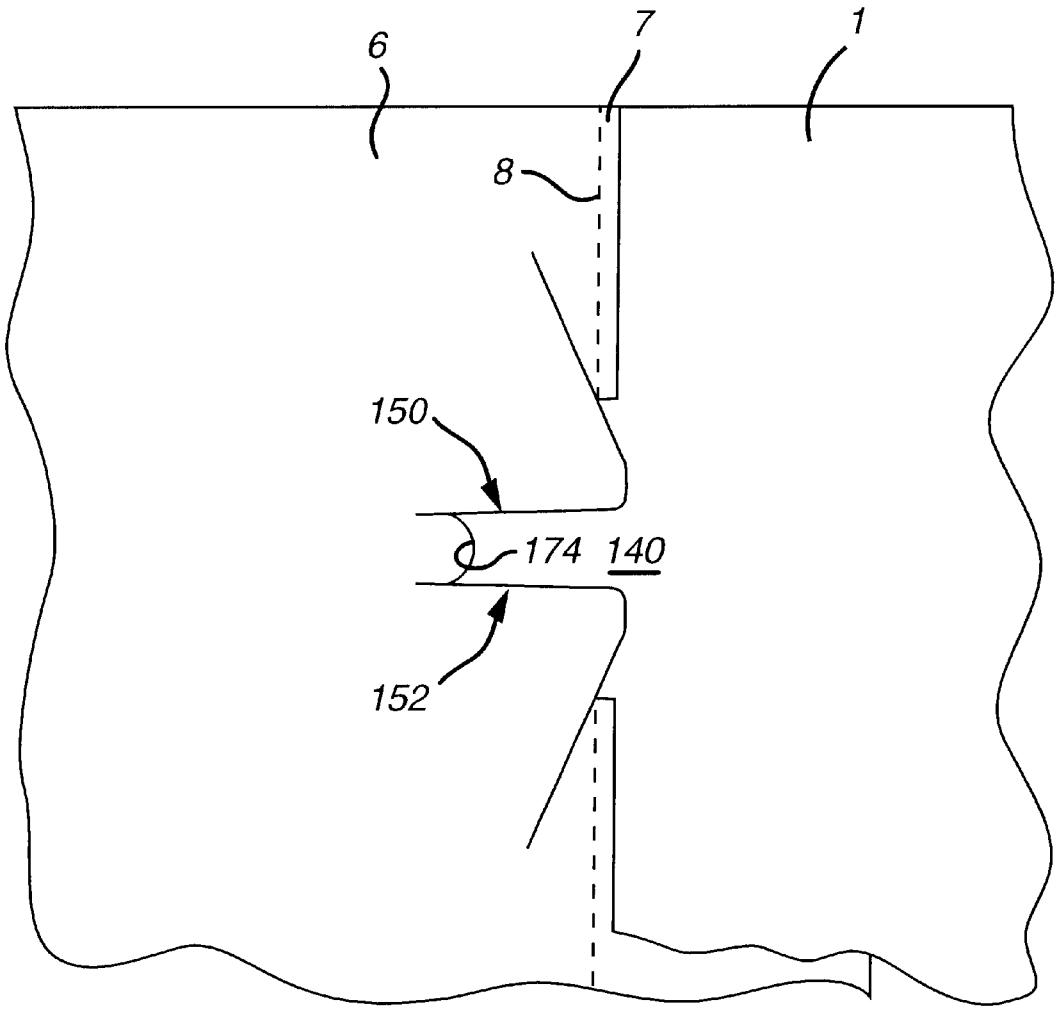

The embodiment of FIGS. 4 and 5 further illustrates an alternative slit arrangement 130. In this embodiment, first portions 154 of slits 150, 152 extend from shoulders 158, disposed in leading edge panel 7, into main panel 6. Unlike the embodiment of FIGS. 13, these portions of slits 150, 152 do not terminate on fold lines 8, but rather terminate within panel 6. Nonetheless, it will be recognized that because shoulders 158 are disposed in leading edge panel 7, folding of panel 7 with result in opening of slits 150 and 152 for receiving tab 120. Such a slit arrangement may be used with the tab illustrated in FIGS. 1–3, although it will be further recognized that panel 1 will therefore overlap panel 5 to a greater extent.

Figure 6:
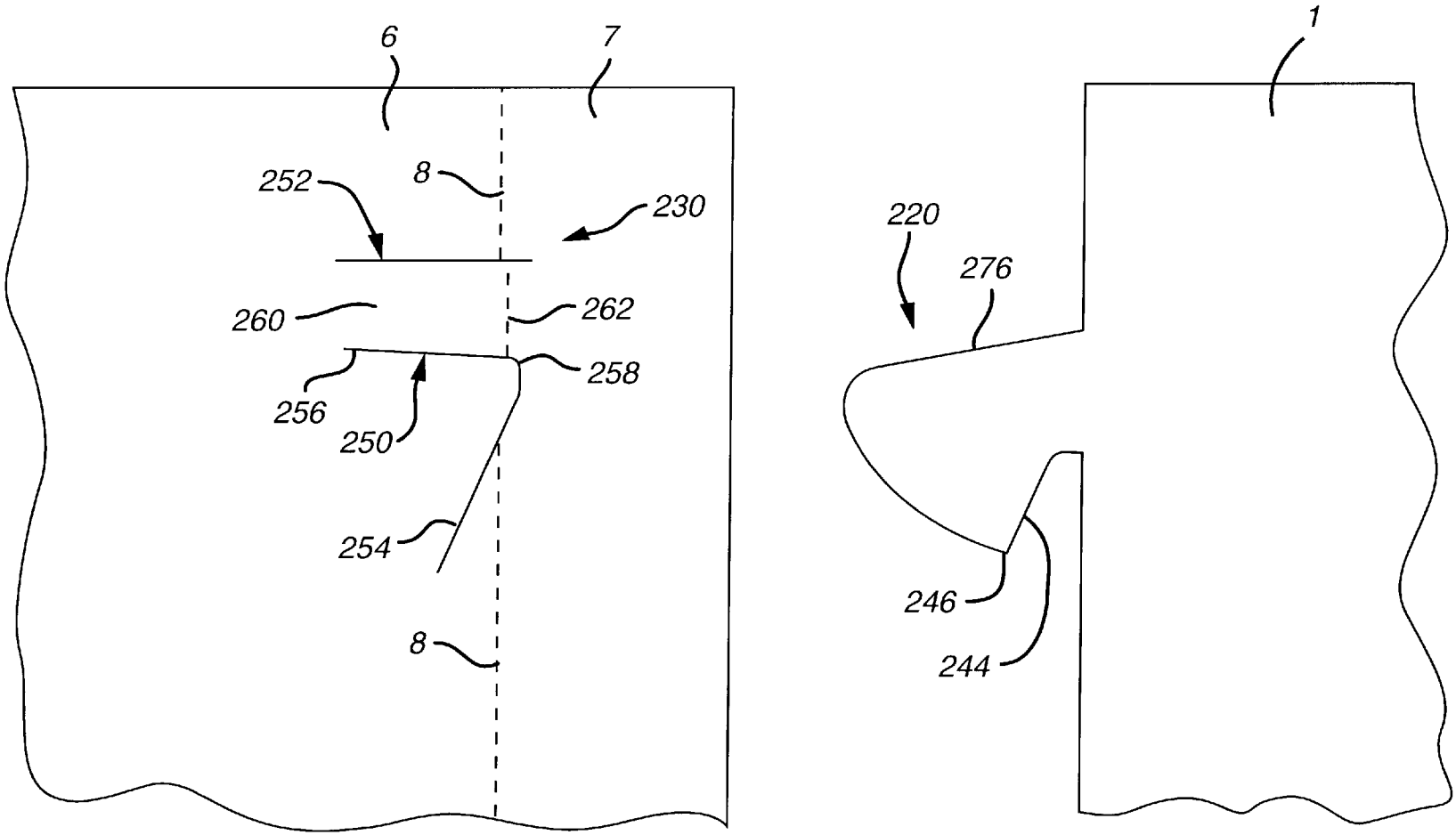
FIGS. 6 and 7 are views similar to FIGS. 2 and 3, respectively, showing a further alternative embodiment for the locking arrangement of the present invention.
Figure 7:
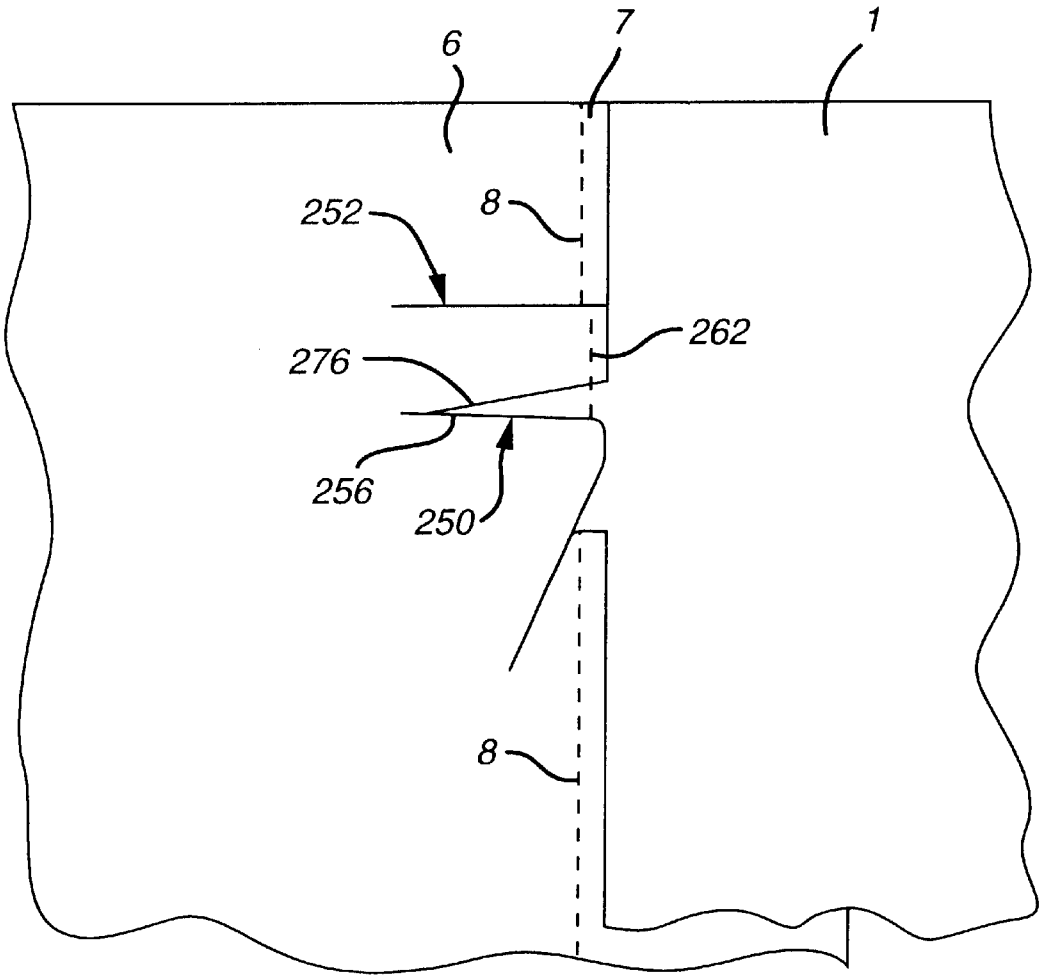

It will be appreciated that still further alternative embodiments of the present invention are possible. For example, it is not necessary that slits 50, 52 be mirror-images of each other. Indeed, as illustrated in the embodiment of FIGS. 6–7, only one of the slits may be used to receive the locking tab. In this embodiment, tab 220 includes only a single locking edge 244 and shoulder 246 defined along one side of tab 220.

Slit arrangement 230 includes a first slit 250, which slit is formed in a manner similar to slits 50 and 150 of the preceding embodiments. Slit 250 includes a first portion 254 connected at a shoulder 258 to second portion 256 which extends rearwardly into panel 6 to partially define strut panel 260. A second slit 252 serves only to define strut panel 260, and may be formed extending from a point at fold line 262 into main panel 6.

In use, leading edge panel 7 is folded along fold lines 8. Strut panel 260 and fold line 262 cooperate with this folding operation to open slit 250 for receiving tab 220. Tab 220 is inserted into slit 250, and the innermost point of slit 250 along portion 256 cooperates with side edge 276 of tab 220 to guide the tab into position within slit 250. Once engaged, tab 220 is held by the innermost point of slit 250 against lateral movement in the direction of strut panel 262. Preferably, a second tab 220 facing in an opposite position may be provided on the carton to prevent lateral movement of the locking arrangement in an opposite direction.

In the event a locking arrangement in accordance with the embodiment of FIGS. 6–7 is used, it may be possible to eliminate the second slit 252 entirely. For example, if the locking arrangement is placed near the side edge of the panels into which it is formed, the side edge of panel 5 may be used in place of slit 252. In such a case, offset fold line 262 will extend from slit 250 to the side edge of the panel 5. In either case, fold line 262 will terminate at a cut edge, and will therefore operate to open the slit 250 for receiving tab 220.

In each of the embodiments described above, a fold line 62, 162, 262 is provided across strut panel 60, 160, 260 which fold line is offset from the fold lines 8 connecting leading edge panel 7 with main panel 6. Such offset causes the strut panel to further open the slits 50, 52, 150, 152, 250. However, it will be recognized that it is possible to align the fold line 62, 162 with fold lines 8 in the first two and similar embodiments. In such case, only the slit shoulders 58, 158 serve to open the slits for receiving the locking tab. However, the strut panel 60, 160 is nonetheless advantageous, in that it facilitates retention of the tab in its locked position.

It will further be recognized that neck 42 may be varied depending upon the relative size of the locking tab 20, the carton and the panels which comprise the carton. For example, neck 42 may be made longer or shorter than depicted in FIGS. 1–3, thereby changing the distance by which main body 40 of locking tab 20 is spaced from the edge of panel 1. Indeed, neck 42 may be formed to have no length at all, in which case the shoulders 44 will be disposed immediately adjacent the leading edge of panel 1.

It is further noted that although the panels 1, 5 and 6 upon which the elements of the interlocking arrangement are illustrated may be considered as bottom panels of the carton shown, use of the interlocking arrangement 10 with panels that ultimately serve as top, side, end or other panels that form a closure is encompassed by and within the scope and spirit of the invention.

What is claimed is:

1. A locking arrangement for panels comprising:

a first panel;

a locking tab extending from said first panel, said locking tab having a main body defining a widened locking shoulder disposed along at least one side edge of said tab;

a second panel having a main portion, and a leading portion connected thereto along at least one panel fold line;

a locking slit defined in said second panel, extending at least from a first point disposed on said leading portion to a second point disposed on said main portion;

a cut edge defined in said second panel, extending at least from a first point disposed in said leading portion to a second point disposed in said main portion;

said locking slit and said cut edge defining therebetween a strut panel;

a strut fold line disposed across said strut panel from said locking slit to said cut edge substantially in parallel to said panel fold line, said strut fold line being disposed in an offset relationship to said panel fold line in a direction toward said leading portion, whereby folding of said leading portion along said panel fold line causes said strut fold line and said strut panel to at least partially open said locking slit for receiving said locking tab thereinto.

2. A locking arrangement as claimed in claim 1, wherein said locking tab further defined a second widened locking shoulder disposed along an opposite side edge of said tab.

3. A locking arrangement as claimed in claim 1, wherein said locking tab further comprises a neck disposed between said locking shoulder and said first panel.

4. A locking arrangement as claimed in claim 3, wherein said locking tab defines a locking edge formed along said neck between said locking shoulder and said first panel, and wherein said first portion of said locking slit is formed such that, when said locking tab is engaged with said locking slit, said locking edge and said first portion of said locking slit are substantially coincident.

5. A locking arrangement as claimed in claim 1, further comprising a second panel fold line, said first and second panel fold lines being collinear.

6. A locking arrangement as claimed in claim 7, wherein said cut edge is defined by a second locking slit formed in said second panel.

7. A locking arrangement as claimed in claim 6, wherein each of said first and second locking slits extend from said first points, each of said first points being disposed astride a respective one of said panel fold lines, into said leading portion and to said second points disposed on said main portion.

8. A locking arrangement as claimed in claim 7, wherein each of said locking slits includes a first portion extending from said first point into said leading portion and a second portion extending from said leading portion into said main portion, and a shoulder portion disposed within said leading portion and which connects said first and second portions of each of said locking slits.

9. A locking arrangement as claimed in claim 8, wherein said strut fold line is disposed across said strut panel from said first locking slit to said second locking slit, intersecting each of said locking slits between respective ones of said shoulder portions and the intersection of said locking slit and one of said panel fold lines.

10. A locking arrangement as claimed in claim 8, wherein said first and second locking slits are substantially mirror-images of each other.

11. A locking arrangement as claimed in claim 8, wherein said first portion of each of said locking slits extends beyond said first point and into said main portion of said second panel.

12. A locking arrangement as claimed in claim 1, wherein said second panel defines a panel side edge therefor, and wherein said cut line is defined by a portion of said panel side edge.

13. A locking arrangement for panels comprising:

a first panel;

a locking tab extending from said first panel, said locking tab having a main body defining a widened locking shoulder disposed along at least one side edge of said tab;

a second panel having a main portion, and a leading portion connected thereto along a plurality of collinear panel fold lines;

a pair of locking slits defined in said second panel, each extending at least from a first point disposed astride one of said panel fold lines, into said leading portion and to a second point disposed on said main portion;

said locking slits defining therebetween a strut panel;

the distance between said first points being greater than the distance between said second points, whereby said locking tab is received into said slits.

14. A locking arrangement as claimed in claim 13, wherein said locking tab further defined a second widened locking shoulder disposed along an opposite side edge of said tab, said locking shoulders engaging said locking slits for retaining said locking tab within said locking slits.

15. A locking arrangement as claimed in claim 14, wherein said locking tab defines a maximum width thereacross at said locking shoulders which is less than or equal to the distance between said first points along said locking slits.

16. A locking arrangement as claimed in claim 13, wherein said locking tab further comprises a neck disposed between said locking shoulder and said first panel.

17. A locking arrangement as claimed in claim 16, wherein said locking tab defines a locking edge formed along said neck between said locking shoulder and said first panel, and wherein said first portion of said locking slit is formed such that, when said locking tab is engaged with said locking slit, said locking edge and said first portion of said locking slit are substantially coincident.

18. A locking arrangement as claimed in claim 13, wherein each of said locking slits includes a first portion extending from said first point into said leading portion and a second portion extending from said leading portion into said main portion, and a shoulder portion disposed within said leading portion and which connects said first and second portions of each of said locking slits.

19. A locking arrangement as claimed in claim 18, wherein said first and second locking slits are substantially mirror-images of each other.

20. A locking arrangement as claimed in claim 18, wherein said first portion of each of said locking slits extends beyond said first point and into said main portion of said second panel.

21. A locking arrangement as claimed in claim 14, wherein said locking tab defines thereon a leading tab edge extending between said locking shoulders, and wherein said main body of said tab defines an alignment notch extending thereinto from said tab leading edge to a notch base, said alignment notch along said leading tab edge having a width greater than the distance between said second points on said locking slits whereby said alignment notch cooperates with said strut panel to laterally retain said locking tab within said locking slits.

22. A locking arrangement as claimed in claim 22, wherein said alignment notch is further defined having a greater width along said tab leading edge than at said notch base.

* * * * *